US005522286A

United States Patent [19]

Wilson, Jr. et al.

[11] Patent Number: 5,522,286

[45] Date of Patent: Jun. 4, 1996

[54] MECHANISM FOR COUPLING AND SELECTIVELY POSITIONING A SOCKET DRIVE TRANSFER ASSEMBLY AND A DRIVER

[75] Inventors: David Wilson, Jr., 8022 Dry Creek Cir., Longmont, Colo. 80503; Bruce D. Steffen, Las Vegas, Nev.

[73] Assignee: David Wilson, Jr., Boulder, Colo.

[21] Appl. No.: 338,696

[22] Filed: Nov. 14, 1994

Related U.S. Application Data

[63] Continuation-in-part of Ser. No. 276,506, Jul. 18, 1994, Pat. No. 5,460,062, which is a continuation of Ser. No. 25,949, Mar. 3, 1993, abandoned.

[51] Int. Cl.[6] ..... B25B 17/00

[52] U.S. Cl. ..... 81/57.26; 81/57.13; 81/58.2

[58] Field of Search ..... 81/56, 57.13, 57.14, 81/57.26, 57.29, 57.3, 58.2

[56] References Cited

U.S. PATENT DOCUMENTS

| | | | |
|---|---|---|---|
| 2,630,731 | 3/1953 | Imboden . | |
| 2,649,823 | 8/1953 | Markovich . | |
| 3,477,318 | 11/1969 | Batten . | |
| 3,620,105 | 11/1971 | Batten . | |
| 4,287,795 | 9/1981 | Curtiss | 81/57.26 |
| 4,322,989 | 4/1982 | Garolis | 81/57.13 |
| 4,538,483 | 9/1985 | Batten | 81/57.14 X |
| 5,050,463 | 9/1991 | Stielow . | |
| 5,052,496 | 10/1991 | Albert et al. | 81/57.13 X |

*Primary Examiner*—James G. Smith
*Attorney, Agent, or Firm*—Harold A. Burdick

[57] ABSTRACT

A mechanism for cooling and accommodating user selected relative positioning of a device for manipulating threaded connectors and a drive powering the device is disclosed. The device includes a housing with a socket and a drive transfer assembly maintained therein. The mechanism includes first and second relatively rotatable coupling rings each at a different one of the housing of the device and the drive unit. Cooperative locating and securing structures are associated with each of the rings, one of the structures having apertures indexed around a circumference thereof for engagement by the other of the structures in selected ones thereof.

19 Claims, 7 Drawing Sheets

MECHANISM FOR COUPLING AND SELECTIVELY POSITIONING A SOCKET DRIVE TRANSFER ASSEMBLY AND A DRIVER

RELATED APPLICATION

This application is a continuation-in-part of U.S. patent application Ser. No. 08/276,506 filed Jul. 18, 1994, U.S. Pat. No. 5,460,062, and entitled "Reaction Unit for Threaded Connector Manipulating Device and Combination Thereof" by David Wilson, Jr., which is a file wrapper continuation of now abandoned U.S. patent application Ser. No. 08/025,949 filed Mar. 3, 1993, now abandoned, and entitled "Compact Manipulating Device For Threaded Connectors" by David Wilson, Jr.

FIELD OF THE INVENTION

This invention relates to tools for manipulating threaded connectors, and, more particularly, relates to devices for coupling socket assemblies to a drive unit.

BACKGROUND OF THE INVENTION

While many devices for manipulating threaded connectors and driving sockets have been heretofore known and/or utilized, a problem persists in their application and use when the connector to be manipulated is located in a cramped, distant, obstructed or awkward to reach space. This has been particularly true where the threaded connector being manipulated is a line fitting (various types of which are utilized to join the ends of conduits, cables, and the like to each other or to another component in a mechanical and/or electrical system). Application and use of such heretofore known devices frequently has involved at least partial disassembly of associated structure or components to gain access to the connector, risked damage to the connector, and/or required awkward manipulation of the socket and/or driver to position the device over the line and/or to engage and manipulate the connector.

Perhaps the most common of such heretofore known devices are simple box wrenches or fitting wrenches. However, use of such standard wrenches, involving movement of the handle of the wrench through a significant arc, is not well suited to applications in cramped locations, or where a plurality of line fittings are closely positioned relative to one another (at least where one does not wish to remove all fittings in a series, or row, of fittings leading to the targeted fitting). Additionally, use of these well known types of wrenches necessarily involves a "hands-on" operation.

Various tools have been suggested to reach fasteners located in cramped areas and/or for application with a power driver (see, for example, U.S. Pat. Nos. 3,477,318, 3,620,105, 2,578,686, 4,374,479, 4,928,559, 5,050,463 and 2,630,731), with such devices, however, likewise not providing for minimization of awkward manipulations of the tool and/or the socket during operation, and/or not optimizing ease of utility, mechanical durability and thus reliability, and compactness of structure. Moreover, these devices have not addressed the need to access obstructed locations (i.e., the ability to work around obstructions or to access fittings from difficult angles). Further improvements in such tools could thus still be utilized.

SUMMARY OF THE INVENTION

This invention provides, in association with or as an overall combination with a driven device for manipulating threaded connectors having a drive transfer assembly maintained at a housing for transmitting rotary motion to a socket, a mechanism for coupling and accommodating selective relative positioning of the housing and a driver utilized to activate the drive transfer assembly.

The mechanism includes first and second relatively rotatable portions, the first portion positioned at the housing of the device and the second portion engageable with the driver, and means for maintaining engagement of the first and second portions. Cooperative locating structure at the first and second portions is provided for securing a user selected relative positioning of the housing and the driver achieved by relative rotation of the first and second portions.

The combination provided a device for manipulating a threaded fitting, the device being releasably engageable with a driver having a driving shaft. The device includes a housing, a socket having an inner periphery engageable with the fitting and rotatably mounted at the housing, and a drive transfer assembly maintained at the housing and engaging the socket for imparting rotational motion to the socket. A coupler at the housing is engageable with the driver for operatively joining the driving shaft of the driver with the drive transfer assembly and includes means for enabling user selection of relative positioning of the housing and the driver from a plurality of possible relative positions without disengaging the coupler from the housing or the driver.

The device and mechanism of this invention are thus configured to minimize the necessity for awkward manipulation of the socket, the device and/or driver, the connector, or the surrounding equipment or structure to achieve positioning on or disengagement from the connector and manipulation of the connector, particularly where the connector is difficult to access because of obstruction or location.

It is therefore an object of this invention to provide an improved device for manipulating threaded connectors which are, because of obstruction or location, more difficult to access.

It is another object of this invention to provide, in association with a device for manipulating threaded connectors, a mechanism for coupling and selectively positioning the device and a driver.

It is another object of this invention to provide a device for manipulating threaded connectors, or fittings, which includes a mechanism for coupling and accommodating selective relative positioning of the device and a driver utilized to activate the device.

It is yet another object of this invention to provide, in association with a device having a drive transfer assembly with a housing and utilized to drive a socket, a mechanism for coupling and selectively positioning a device for manipulating threaded connectors and a driver, the mechanism including first and second relatively rotatable portions, the first portion positioned at the housing of the device and the second portion engageable with the driver, and means for maintaining engagement of the first and second portions.

It is still another object of this invention to provide, in association with a drive transfer assembly having a housing and at least a first gear rotatable to transmit rotary motion to a socket positionable at the housing, a mechanism for selectively positioning a driver and the drive transfer assembly including first and second relatively rotatable portions, the first portion positioned at the housing and the second portion engageable with the driver, and cooperative locating structure at the first and second portions for securing a user selected relative positioning of the housing of the drive transfer assembly and the driver achieved by relative rotation of the first and second portions.

It is yet another object of this invention to provide a device for manipulating a threaded fitting, the device being releasably engageable with a driver having a driving shaft and including a housing, a socket having an inner periphery engageable with the fitting and rotatably mounted at the housing, a drive transfer assembly maintained at the housing and engaging the socket for imparting rotational motion to the socket, and a coupler at the housing engageable with the driver for operatively joining the driving shaft of the driver with the drive transfer assembly and including means for enabling user selection of relative positioning of the housing and the driver from a plurality of possible relative positions without disengaging the coupler from the housing or the driver.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
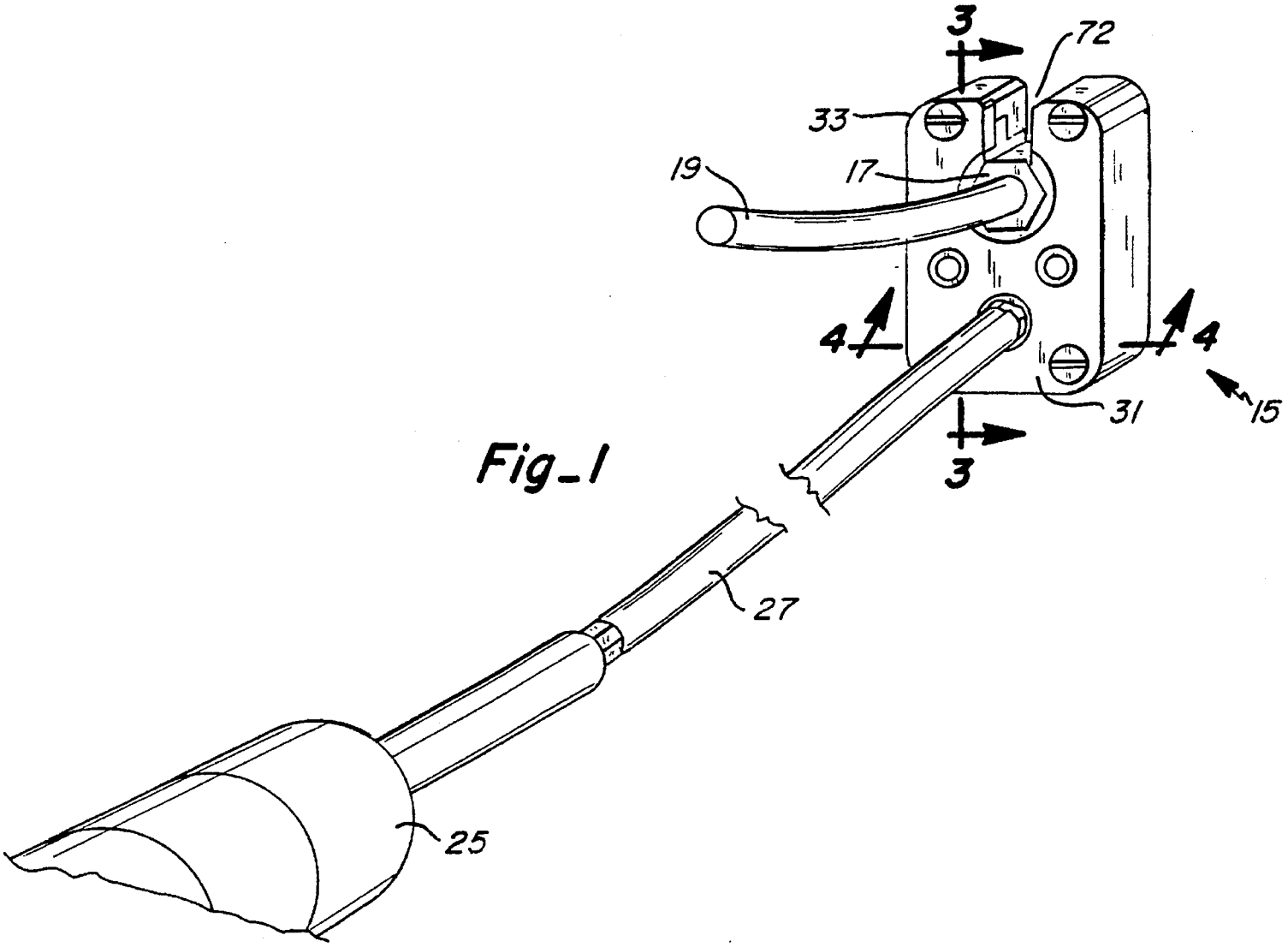
FIG. 1 is a perspective view of the socket drive transfer assembly of this invention.

FIGS. 1 through 4 illustrate an embodiment 15 of a socket and drive transfer assembly in accord with this invention. Device 15 is shown in FIG. 1 in use to manipulate line fitting 17 around line segment 19 into engagement or disengagement with matable fitting 21 around line segment 23. Device 15 is releasably engaged with power driver 25 using flexible shaft 27 (though direct power driver engagement could be provided as shown hereinafter).

Figure 2:
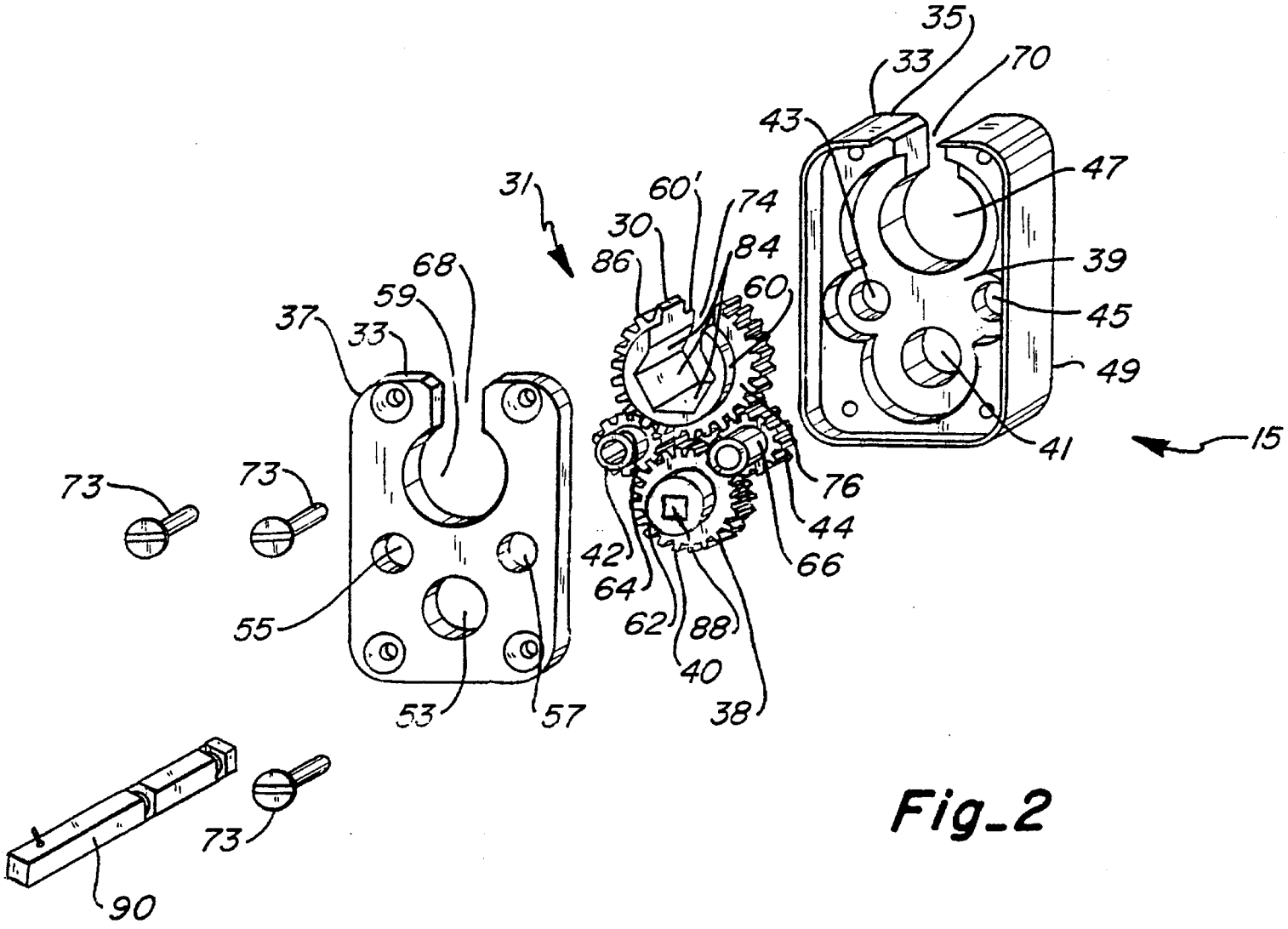
FIG. 2 is an exploded view of the drive transfer assembly of FIG. 1.
Figure 3:
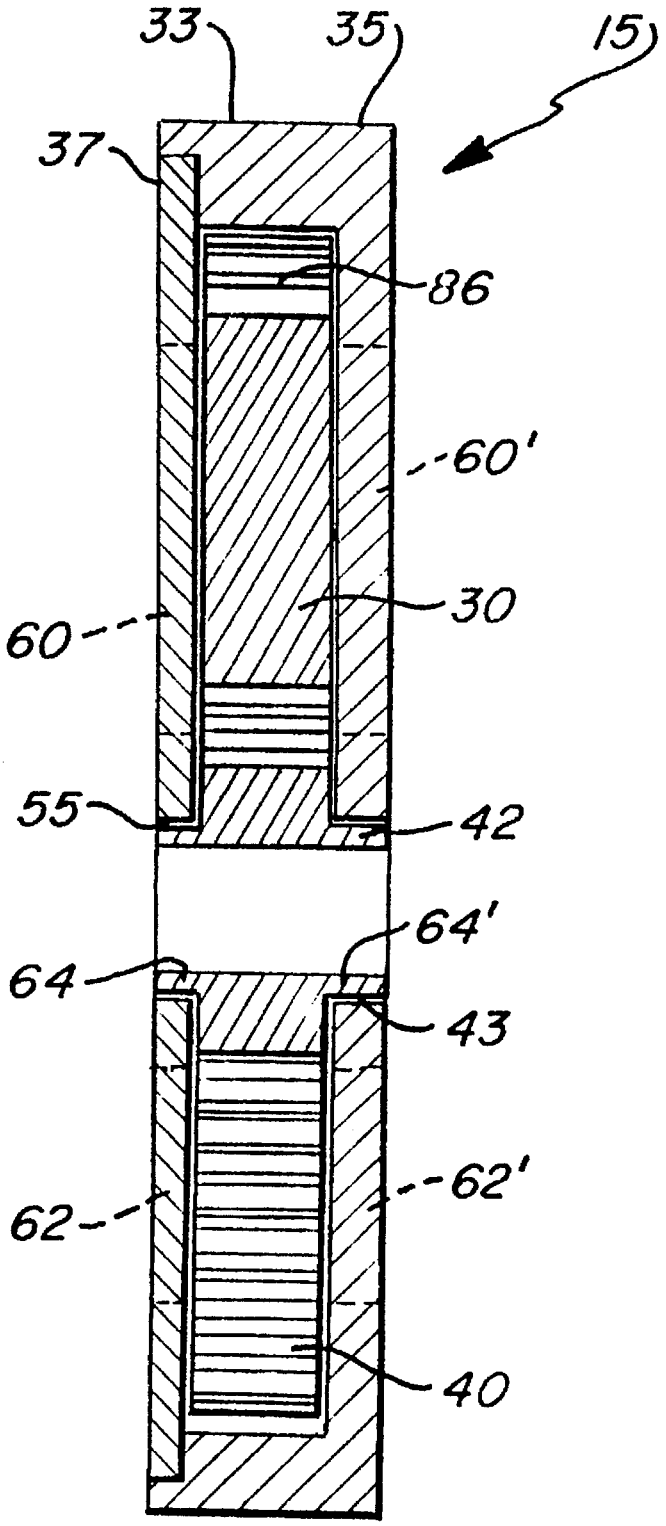
FIG. 3 is a sectional view taken through section lines 3—3 of FIG. 1.
Figure 4:
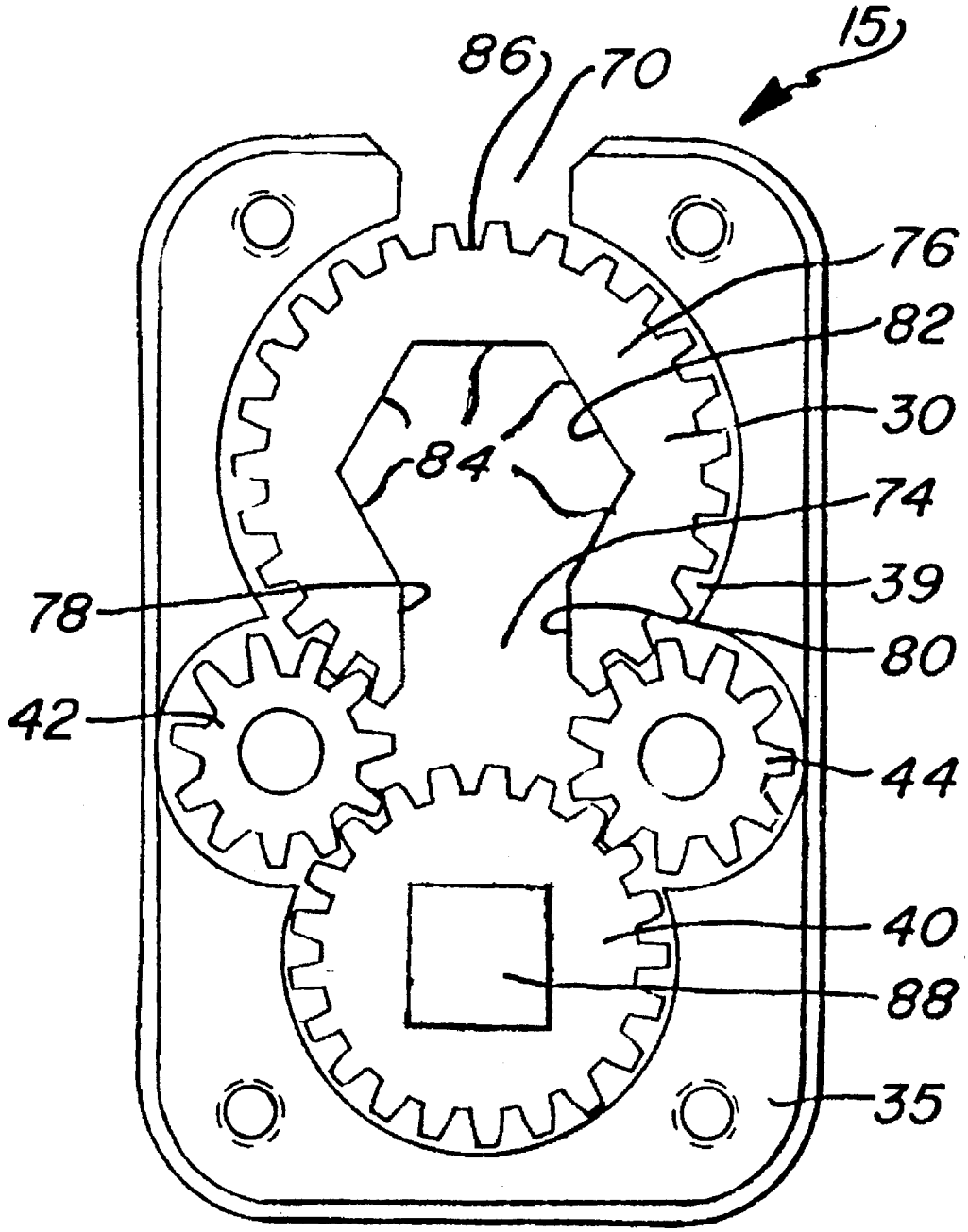
FIG. 4 is a sectional view taken through section lines 4—4 of FIG. 1.
Figure 5:
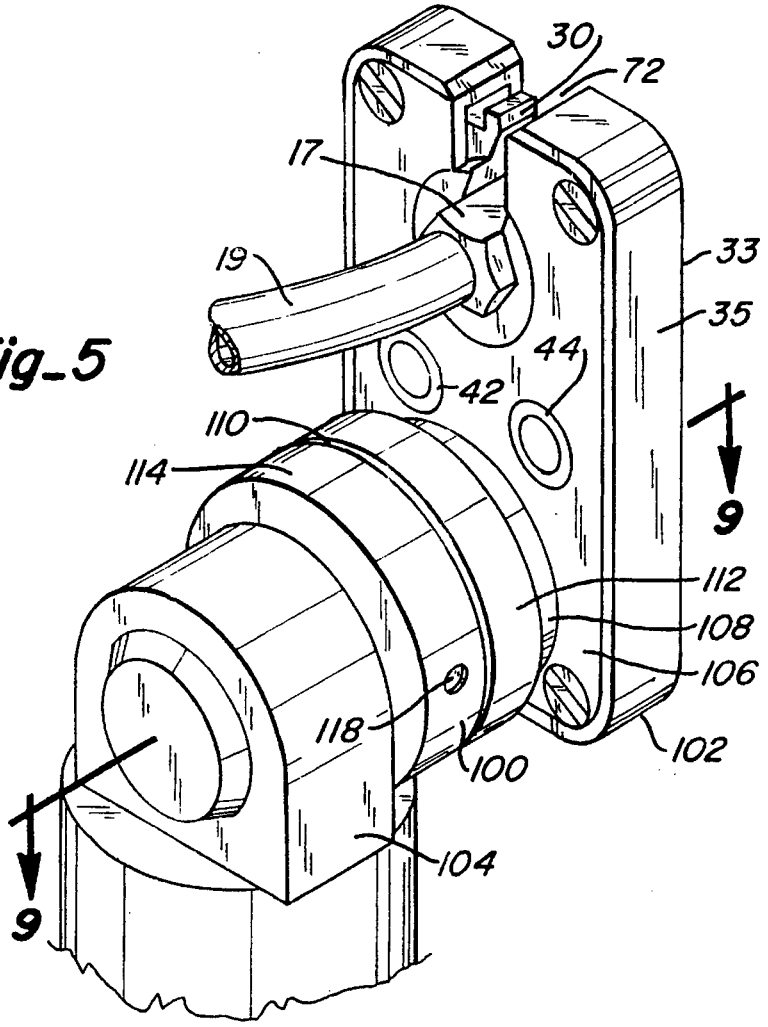
FIG. 5 is a perspective view of the coupling and positioning mechanism of this invention together with a driver and a drive transfer assembly similar to that illustrated in FIG. 1.

Turning to FIGS. 2, 3 and 4, device 15 includes socket 30 and drive transfer assembly 31. Drive transfer assembly 31 includes housing 33, formed by main housing body 35 and cover section 37, and gear train 38 including main drive gear 40 and linkage gears 42 and 44 for imparting rotational motion to socket 30 when driven by driver 25. Housing body 35 has indented structure 39 formed therein and openings 41, 43, 45 and 47 through rear wall 49 for housing socket 30 and drive transfer assembly 31. Cover section 37 includes openings 53, 55, 57 and 59, the corresponding openings in body 35 and cover section 37 receiving arcuate shoulders 60, 60', 62, 62', 64, 64', and 66, 66'(66' not shown but being substantially the same as 64') of socket 30 and gears 40, 42 and 44, respectively, thus eliminating any need for axles, shafts, bearings and the like (though different structures, including bearings, could be utilized).

Both cover section 37 and main body 35 include gaps 68 and 70, respectively, extending from openings 59 and 47, respectively, the thus formed gap 72 in housing 33 (when assembled, utilizing, for example, machine screws 73, only 3 of which are shown in FIG. 2) corresponding in size to gap 74 formed in side wall 76 of socket 30 between spaced edges 78 and 80 thereof (though, in some applications, gaps 68 and/or 70 may be narrower than gap 74, being only slightly greater in size than the diameter of a line 19 upon which the fitting is mounted). Side wall 76 is defined between inner periphery 82 (which may be variously configured for receiving the connector to be manipulated, a hex fitting configuration with a plurality of facets 84 being illustrated herein) and the outer periphery of the socket which includes engageable outer periphery 86 as well as the outer periphery of shoulders 60 and 60'.

Drive gear 40 includes power driver attachment opening 88 for receipt of a rotatable shaft (such as flex shaft 27 or rigid shaft 90, various opening configurations being possible to accommodate the particular cross-sectional configuration of the driver shaft, i.e., square, hexagonal or the like). Gear 40 and socket 30 may be of a selected size relative to one another to provide selected operational characteristics, and preferably are of a size relative to one another to provide gear reduction (for example, about a 20% reduction). The housing, socket and gears are preferably formed of metals, though various plastics could be utilized in some applications for some of the parts of the device.

While various sizes of device 15 are employed depending upon the size of connector involved, all are compact relative to the task, compactness, as well as durability, being achieved because of the particular relationship of gap size and gear sizes and/or placement of gears. In one particularly useful embodiment of the device, overall measurements of the device are less than about 4 cm (3.2 cm) by 6 cm (5 cm) by 1.5 cm (0.9 cm) with a gap size of about 0.8 cm. This embodiment is utilized, for example, with a 1 cm hex nut, thus providing a gap which is no more than about 75% the size of the fitting. In this manner, once the line is passed through the gap and the fitting is engaged, no non-rotational movement of the socket relative to the fitting in directions normal to the axis of rotation of the fitting can occur, sufficient facets 84 being provided to hold the fitting and socket in engagement. Thus, the likelihood of damage to and/or disengagement from the fitting is reduced during operation of the device.

Moreover, by reducing the size of the gap, linkage gears 42 and 44 can be more closely spaced while still retaining, and in fact improving, sufficient engagement with outer periphery 86 of socket 30 (two cogs being engaged by each linkage gear except during passage of gap 74, assuring a minimum of two cog engagement at all times as shown in FIG. 4) thereby diminishing the likelihood of damage to the gears and thus failure of the device. This may be achieved with linkage gear spacing at their nearest point substantially equal to gap size.

For example, utilizing the embodiment above discussed, the linkage gears can be positioned with the angle defined by lines extending between the axis of rotation of the socket and the axes of rotation of each of the linkage gears at about 73.66°. With about an 0.8 cm gap, the angle defined by lines extending between the axis of rotation of the socket and each of the edges of the side wall is about 48° (a ratio of about 1.5 to 1).

Figure 8:
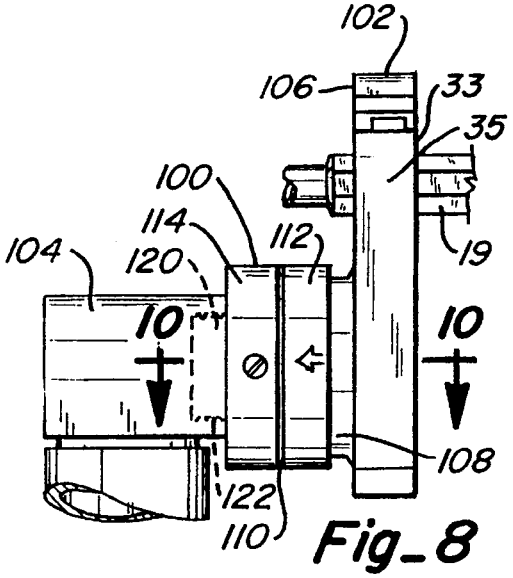
FIG. 8 is a side view of the mechanism, driver and drive transfer assembly of FIG. 5.
Figure 9:
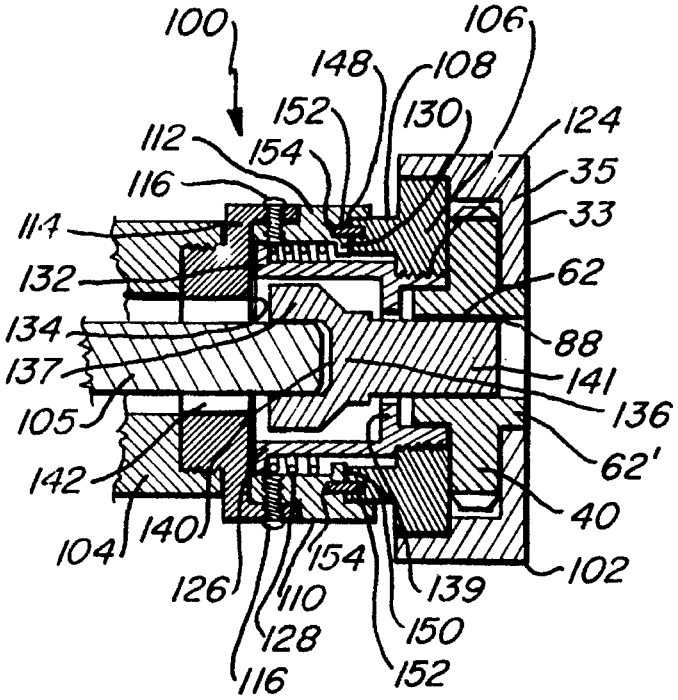
FIG. 9 is a sectional view taken through section lines 9—9 of FIG. 1.

Turning now to FIGS. 5 through 11, the preferred embodiment of mechanism 100 for coupling and selectively positioning device 102 (which is substantially the same in most regards as device 15 of FIG. 1, differences being pointed out hereinafter) and driver 104 (a right angle power driver having a driving shaft 105 shown in FIG. 9) is illustrated. Housing cover section 106 (interchangeable at housing 33 on housing body 35 with cover section 37 of FIG. 2) is provided with coupling ring 108 milled at cover section 106 as shown in FIGS. 5 through 11 (and thus a unitary structure). It is to be realized that ring 108 could be attached by conventional means to a cover section 37 heretofore described.

Assembly 110 includes coupling ring 112 and mount 114 connectable, with mount 114 nested over shoulder 115 of ring 112, by screws 116 at threaded holes 118. Assembly 110 is connectable with power driver 104 by threaded nipple 120 of mount 114 in standard threaded port 122 of driver 104 (see FIG. 8). Thus, coupling ring 108 and assembly 110 are in a fixed position relative to device 102 and driver 104, respectively. As shown hereinafter, however, coupling rings 108 and 112 are movable, both rotatably and axially, relative to one another when mechanism 100 is fully assembled coupling device 102 and driver 104 and with ring 112 mounted over ring 108 in a nested relationship.

Housing cover section 106 has threaded port 124 (at the position of opening 53 shown in FIG. 2) opposite driver attachment opening 88 of drive gear 40 (see FIGS. 6, 9 and 10) to provide access to opening 88 and a point of attachment for mechanism 100 to device 102 (other means of attachment of the mechanism could be provided however in conjunction with ring 108). Threaded retainer 126 is mounted through aperture 127 of ring 112 and aperture 129 of ring 108 and connected at threaded port 124 thereafter providing a bearing surface for drive gear 40 (see FIG. 9). Spring 128 is mounted between circumferential lips 130 and 132 of ring 112 and retainer 126, respectively, to bias ring 112 (and assembly 110) toward and into nested contact with ring 108 when lip 132 is abutting inner surface 134 of mount 114 (see FIG. 9).

Freely rotatable link 136 is maintained at aperture 138 of retainer 126 with link body 137 retained between inner circumferential lip 139 of retainer 126 (see FIGS. 9 and 10) and inner surface 134 of mount 114 when mount 114 is connected to ring 112. Link 136 includes shaft 141 extending from body 137 of a length sufficient to pass through port 124 at housing cover 106 and into driving engagement at opening 88 of drive gear 40 when the mechanism is assemble on device 102. Opening 140 is defined at link body 137 for receipt thereat of driving shaft 105 of driver 104 through aperture 142 of mount 114 of assembly 110 (again, various opening configurations are possible to accommodate the particular cross-sectional configuration of driving shaft 105).

Figure 6:
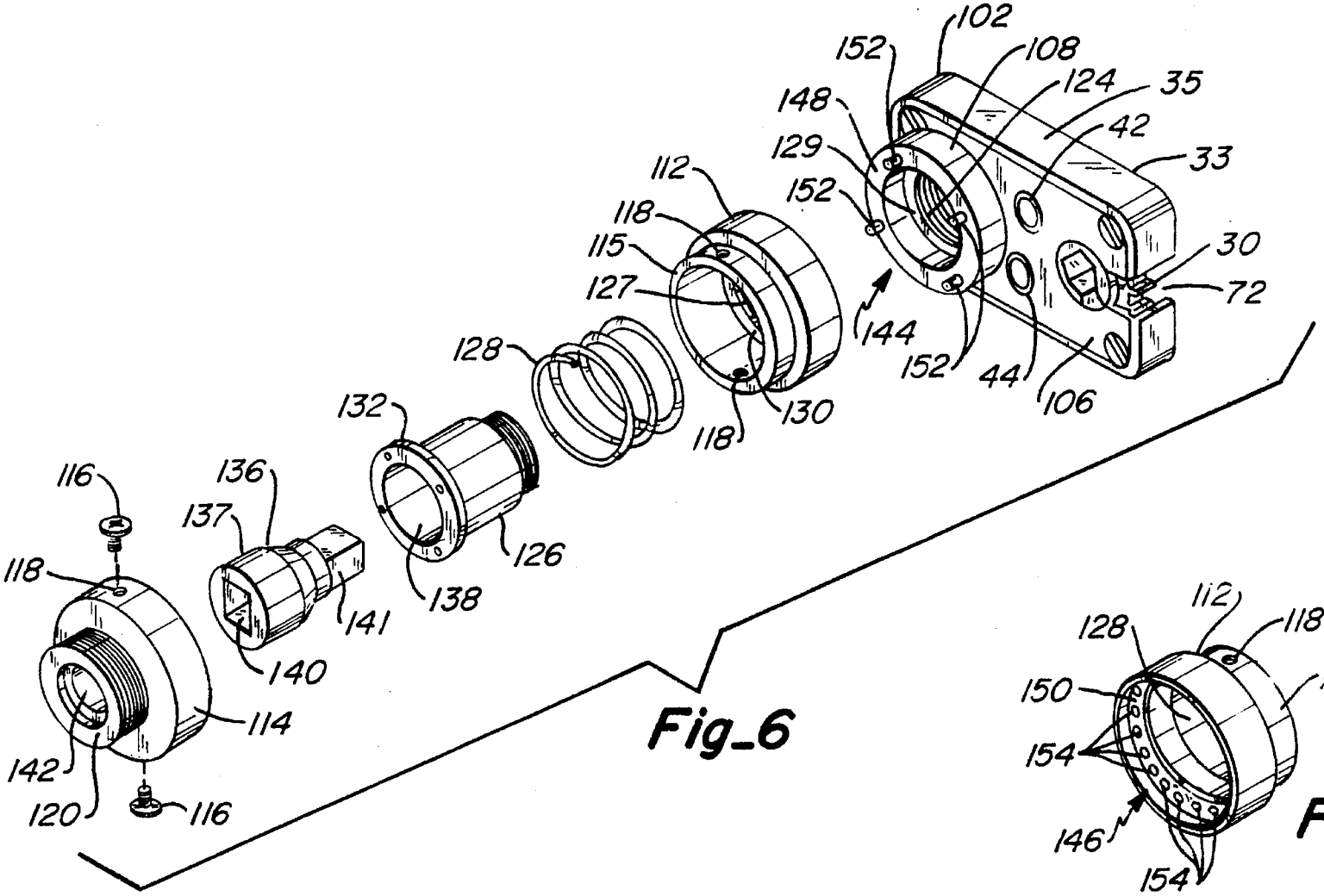
FIG. 6 is an exploded view of the mechanism of FIG. 5.
Figure 7:
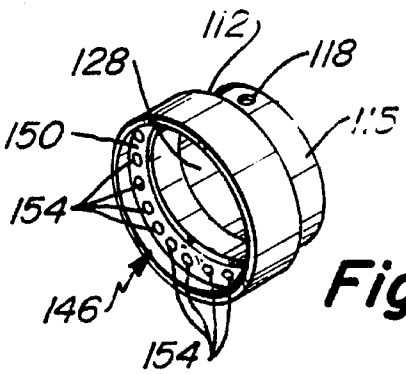
FIG. 7 is a perspective view of a part of the mechanism of FIG. 5.

With reference now to FIGS. 6 and 7, cooperative locating structures 144 and 146 for maintaining a selected relative positioning of device 102 and driver 104 once selected by a user are defined at opposing circumferential surfaces 148 and 150, respectively, of coupling rings 108 and 112, respectively. Structure 144 comprises a plurality of pins 152 (only one is required, additional pins being provided for strength and durability) arranged at intervals around circumferential surface 148.

Structure 146 comprises a plurality of apertures 154, greater in number than the number of pins 152, indexed at intervals around the entire 360° of circumferential surface 150 (it is of course apparent that pins 152 could be at surface 150 and apertures 154 at surface 148). The intervals of pins 152 and apertures 154 are calculated so that all of the pins will engage with selected ones of the apertures when biased into engagement by spring 128 thus providing a plurality of possible locations for each of pins 152 equal in number to the number of apertures 154.

Turning now to FIGS. 8 through 11, use of mechanism 100 to position device 102 relative to driver 104 will be described. Once assembled and connected to driver 104, shaft 105 drivingly engages opening 140 of link 136. Surfaces 148 and 150 of coupling rings 108 and 112 are biased into contact by spring 128 with pins 152 engaged in selected ones of apertures 154 (FIG. 9). Activation of driver 104 will cause rotation of shaft 105, link 136 and thus drive gear 40 to operate device 102 (i.e., rotating linkage gears 42 and 44 and thus socket 30), while the relative position of driver 104 and device 102 is maintained constant by mechanism 100 (and in particular the engagement of locating structures 144 and 146).

Figure 11:
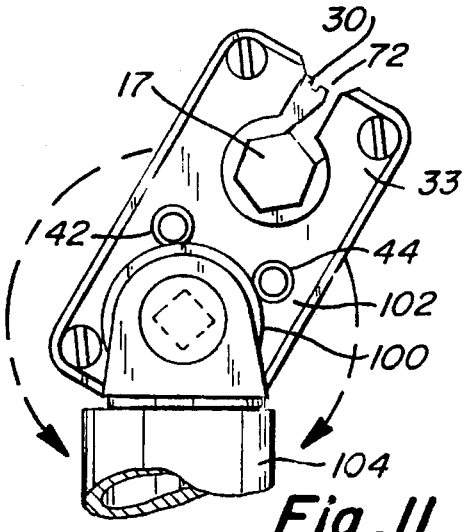
FIG. 11 is a front view of the mechanism, driver and drive transfer assembly of FIG. 5 illustrating selective relative positioning of the drive transfer assembly and the driver utilizing the mechanism of this invention.
Figure 10:
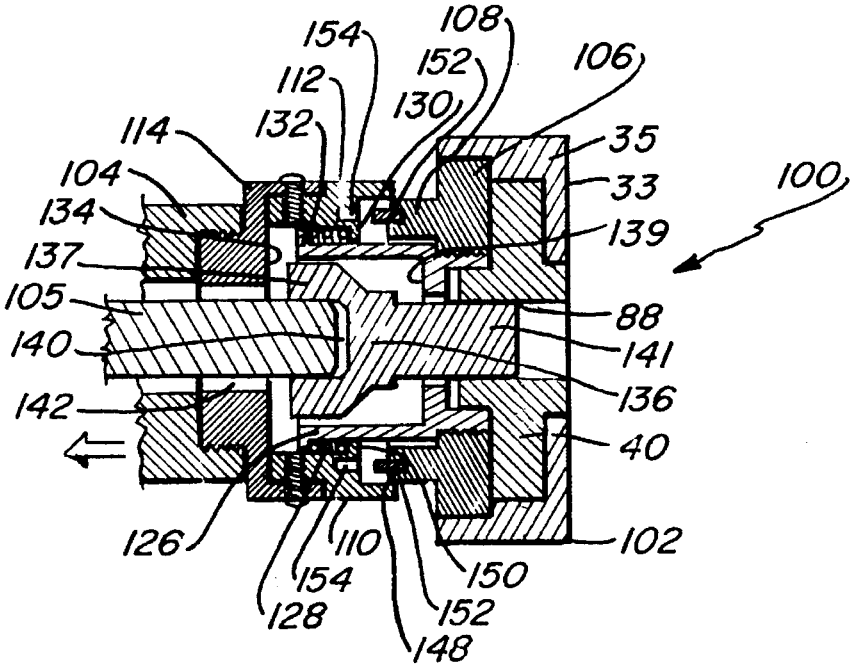
FIG. 10 is a sectional view taken through section lines 10—10 of FIG. 8.

As shown in FIGS. 8, 10 and 11, the relative position of device 102 and driver 104 can be changed to any of plurality of relative positions equal in number to the number of apertures 154 of locating structure 146. A user overcomes the bias of spring 128 by moving device 102 away from driver 104 thus separating ring surfaces 148 and 150 (lip 132 of retainer 126 being slidable along the inner wall of aperture 128 of ring 112 and providing alignment during movement) and disengaging pins 152 from apertures 154. Rotation of device 102 is then made possible relative to driver 104 through 360° of arc by rotation of ring 108 in ring 112 of assembly 110.

When the user has selected the desired relative position of device 102 and driver 104, surfaces 148 and 150 of rings 108 and 112 are again biasing together by spring 128, thus bringing pins 152 and apertures 154 thereat into engagement securing the newly selected relative positioning for operation of device 102. In this manner, the angle of device 102 relative to driver 104 can be changed (see FIG. 11), for example to work around an obstruction or to access a fitting located in surrounding structure at a difficult angle.

What is claimed is:

1. A mechanism for coupling and selectively positioning a device for manipulating threaded connectors and a driver, the device including a drive transfer assembly maintained at a housing, said mechanism comprising:

first and second relatively rotatable portions, said first portion positioned at the housing of the device and said second portion engageable with the driver;

a retainer one part of which is adjacent to said second portion and another part of which is engageable with one of said first portion and the housing of the device; and biasing means adjacent to said second portion and said retainer for biasing one of said first and second portions toward the other of said first and second portions, said portions being relatively rotatable only when a user overcomes the bias of said biasing means and moves said first and second portions away from one another.

2. The mechanism of claim 1 wherein the driver has a driving shaft, said mechanism further comprising a rotatable link retained adjacent to said first and second portions for operatively joining the driving shaft of the driver with the drive transfer assembly of the device.

3. The mechanism of claim 1 wherein said second portion includes a mount engageable with the driver and a coupling ring connectable with said mount and retained adjacent to said first portion.

4. The mechanism of claim 1 wherein the drive transfer assembly of the device includes a drive gear having a centrally engageable part, and wherein said first and second portions of said mechanism and the housing of the device all have apertures therethrough which are aligned with the engageable part of the drive gear of the drive transfer assembly of the device when said mechanism is assembled coupling the device and driver.

5. The mechanism of claim 1 wherein said first portion includes one of apertures and a pin at a circumference thereof, and wherein said second portion includes the other of apertures and a pin at a circumference thereof, said pin being engageable in a selected one of said apertures when said first and second portions are biased together by said biasing means.

6. In association with a drive transfer assembly having a housing and at least a first gear rotatable to transmit rotary motion to a socket positionable at the housing, a mechanism for selectively positioning a driver having a driving shaft and the drive transfer assembly comprising:

first and second relatively rotatable portions, said first portion positioned at the housing and said second portion engageable with the driver;

a rotatable link retained adjacent to said first and second portions for operatively joining the driving shaft of the driver with the first gear of the drive transfer assembly of the device; and cooperative locating means at said first and second portions for securing a user selected relative positioning of the housing of the drive transfer assembly and the driver achieved by relative rotation of said first and second portions.

7. The mechanism of claim 6 wherein said portions are relatively rotatable through 360° of arc.

8. The mechanism of claim 6 wherein said cooperative locating means includes a plurality of pins at one of said first and second portions and a plurality of apertures at the other of said first and second portions.

9. The mechanism of claim 8 wherein said cooperative locating means includes biasing means for biasing one of said first and second portions toward the other of said first and second portions with said pins engaging selected ones of said apertures.

10. The mechanism of claim 8 wherein said apertures are indexed at regular intervals around a circumference of said one of said first and second portions.

11. The mechanism of claim 9 wherein said cooperative locating means includes retaining means having said biasing means thereat for maintaining engagement of said first and second portions while allowing axial relative movement of said first and second portions.

12. The mechanism of claim 6 wherein said second portion includes a mount engageable with the driver and a coupling ring connectable with said mount and retained adjacent to said first portion.

13. A device for manipulating a threaded fitting, said device being releasably engageable with a driver having a driving shaft, said device comprising:

a housing;

a socket having an inner periphery engageable with the fitting and rotatably mounted at said housing;

a drive transfer assembly maintained at said housing and engaging said socket for imparting rotational motion to said socket; and a coupler at said housing and engageable with the driver for operatively joining the driving shaft of the driver with said drive transfer assembly and including positioning means for enabling user selection of relative positioning of said housing and the driver from a plurality of possible relative positions without disengaging said coupler from said housing or the driver.

14. The device of claim 13 wherein said socket has an engageable outer periphery, and wherein said drive transfer assembly includes a drive gear operatively joinable by said coupler with the driving shaft of the driver and at least a first linkage gear engaging said drive gear and said outer periphery of said socket.

15. The device of claim 14 wherein said coupler includes a rotatable link for releasably joining the driving shaft of the driver with said drive gear of said drive transfer assembly.

16. The device of claim 13 wherein said positioning means of said coupler includes first and second relatively rotatable portions.

17. The device of claim 16 wherein a plurality of pins are described around a circumference of one of said first and second portions and a plurality of apertures are described around a circumference of the other of said first and second portions, said pins being engageable in selected ones of said apertures.

18. The device of claim 16 wherein said positioning means further includes biasing means for biasing said second portion toward said first portion, said portions being relatively rotatable for enabling user selection of relative positioning of said housing and the driver only when the user overcomes the bias of said biasing means and moves said first and second portions away from one another.

19. The device of claim 18 wherein said positioning means further includes retaining means having said biasing means thereat for maintaining engagement of said first and second portions while allowing axial relative movement of said first and second portions.

* * * * *